US005125885A

United States Patent [19]

Wooley et al.

[11] Patent Number: 5,125,885

[45] Date of Patent: Jun. 30, 1992

[54] BONDED ENVELOPE STACK AND METHOD AND APPARATUS FOR MAKING SAME

[75] Inventors: Robert E. Wooley, Charlotte, N.C.; A. Derrell Hightower, Stone Mountain, Ga.

[73] Assignee: National Service Industries, Inc., Atlanta, Ga.

[21] Appl. No.: 589,510

[22] Filed: Sep. 28, 1990

[51] Int. Cl.[5] ..... B31B 21/62; B31B 21/98

[52] U.S. Cl. ..... 493/14; 493/28; 493/210; 493/245; 493/249; 493/264

[58] Field of Search ..... 493/13, 14, 21, 27, 493/28, 210, 243, 245, 249, 260, 261, 262, 263, 264

[56] References Cited

U.S. PATENT DOCUMENTS

| | | | |
|---|---|---|---|
| 2,670,664 | 3/1954 | Heitmann | 493/249 |
| 3,380,579 | 4/1968 | Pinto | 493/264 |
| 3,400,642 | 9/1968 | Stemmler | 93/62 |
| 3,450,009 | 6/1969 | Dohnalik | 93/62 |
| 3,548,781 | 12/1970 | Hornung | 118/5 |
| 3,587,844 | 6/1971 | Wing | 206/57 A |
| 3,587,845 | 6/1971 | Wing | 206/57 A |
| 3,630,125 | 12/1971 | Helm | 93/62 |
| 3,641,883 | 2/1972 | Smithe et al. | 93/62 |
| 3,666,261 | 5/1972 | Helm | 271/45 |
| 3,745,894 | 7/1973 | Helm | 93/61 |
| 3,747,561 | 7/1973 | Helm | 118/259 |
| 3,847,384 | 11/1974 | Bethke | 217/80 |
| 3,915,302 | 10/1975 | Farrelly | 206/460 |
| 4,138,933 | 2/1979 | Helm | 93/61 |
| 4,373,986 | 2/1983 | Cone | 156/552 |
| 4,500,000 | 2/1985 | Membrino | 206/554 |
| 4,502,599 | 3/1985 | Perecman | 206/554 |
| 4,534,752 | 8/1985 | Ferrell et al. | 493/213 |
| 4,674,634 | 6/1987 | Wilson | 206/554 |

OTHER PUBLICATIONS

Brochure of Precision Adhesive Placement, South El Monte, Ca., for VanSco Micro-Track System with VACOS Software, dated Oct. 1986.

Brochure of F. L. Smithe Machine Company, Inc., Duncansville, Pa., for RA 800 Series Envelope Machines (copyrighted 1984).

*Primary Examiner*—William E. Terrell

*Attorney, Agent, or Firm*—Mason, Fenwick & Lawrence

[57] ABSTRACT

A bonded unitized envelope stack, manufacturing apparatus, and manufacturing method are provided in which envelopes in a stack are inter-connected by application of two spots of adhesive on the front panel of each envelope to engage the lower panel of the next above envelope. In one embodiment of the present invention, a conventional folding machine including a seal folder flap trap is modified to enable the application of the two spots of adhesive on the front panel of each envelope, and to produce bonded envelope stacks having a given fixed quantity of envelopes. When an envelope enters the seal folder flap trap, a photocell detects and triggers one counter of a dual counter system. A first counter increments each time an envelope enters the trap, until a count termed "preset 1" is reached. When "preset 1" is reached by the first counter, the glue applicator is deactivated. A second counter is then incremented. When a second present count termed "preset 2" is reached by the second counter, the second counter is reset and the apparatus is deactivated. When an envelope enters the seal folder flap trap, the envelope stops and reverses direction, and two spots of adhesive from two glue applicator heads are applied to the front of the envelope near the bottom fold through two slots cut through the seal flap trap plate.

16 Claims, 3 Drawing Sheets

FIG. 2
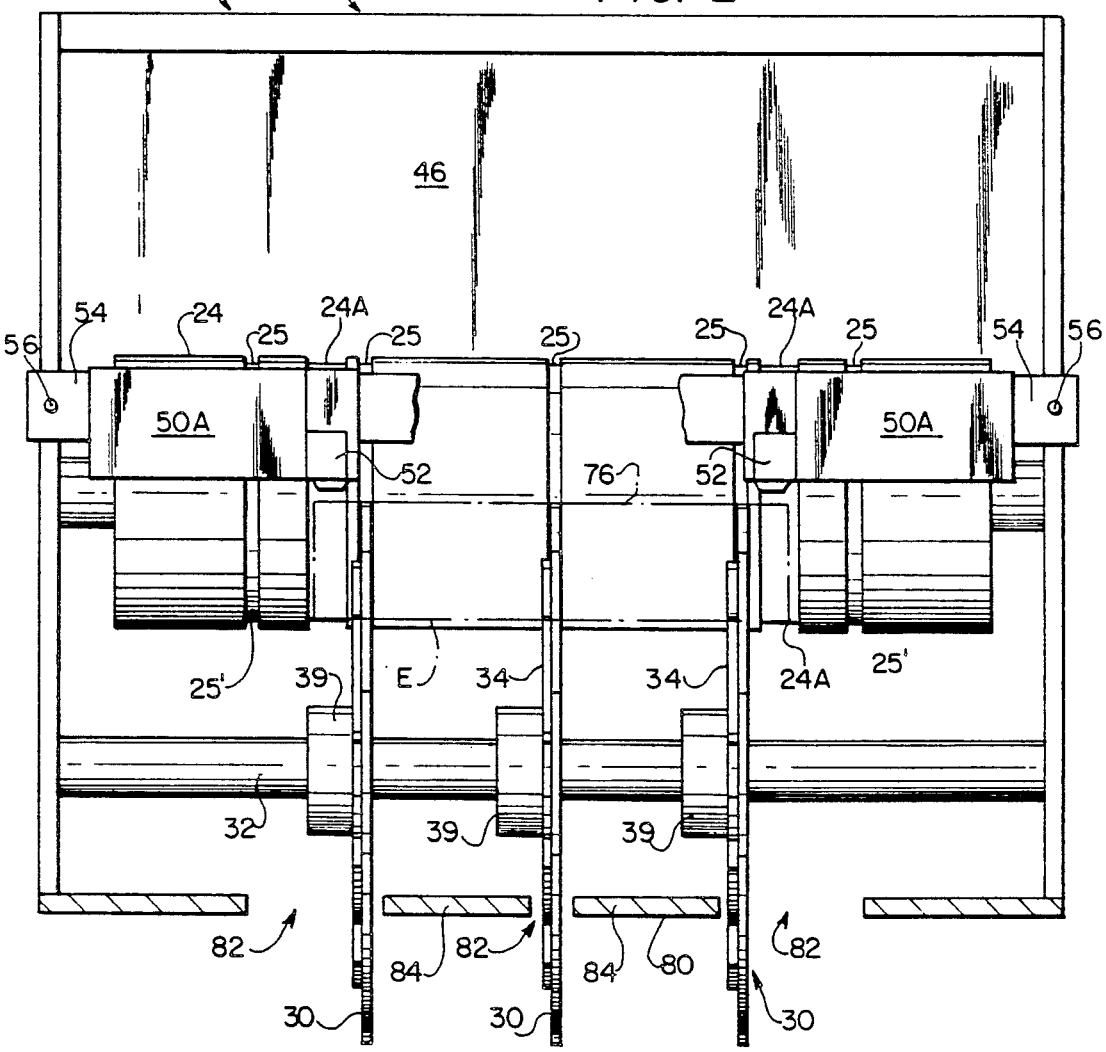
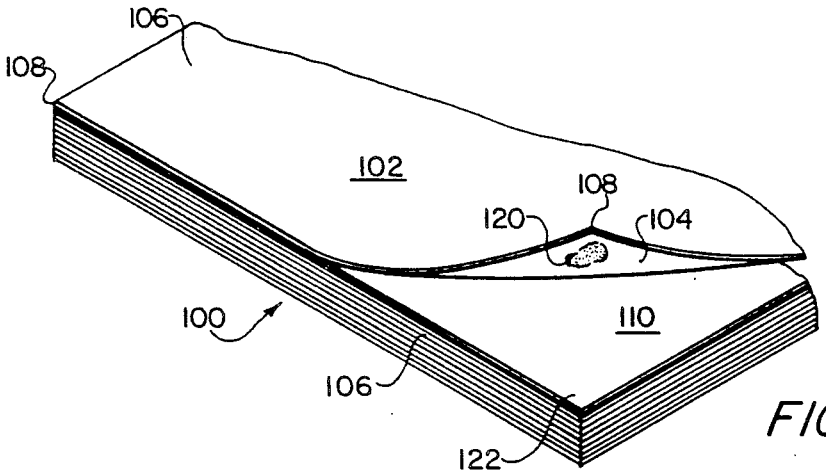
FIG. 3

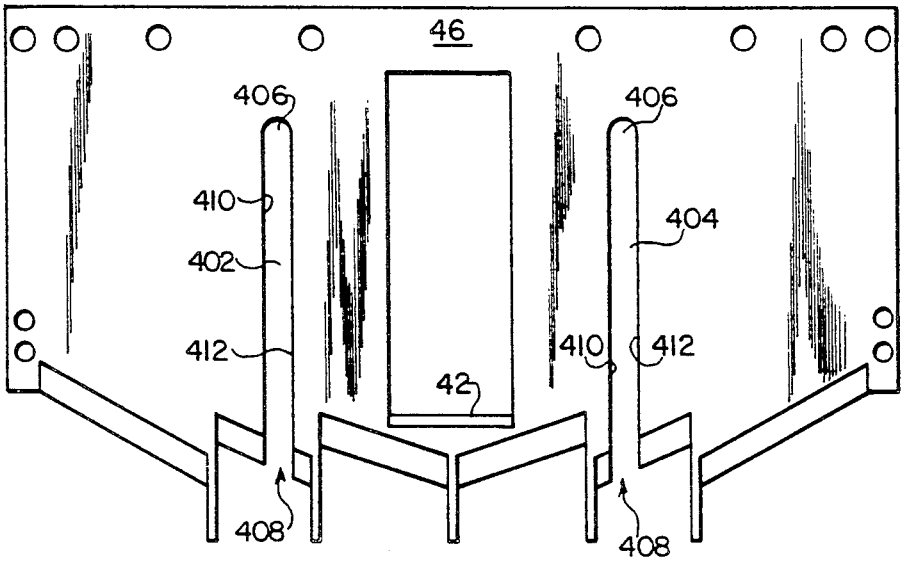
FIG. 4
FIG. 5
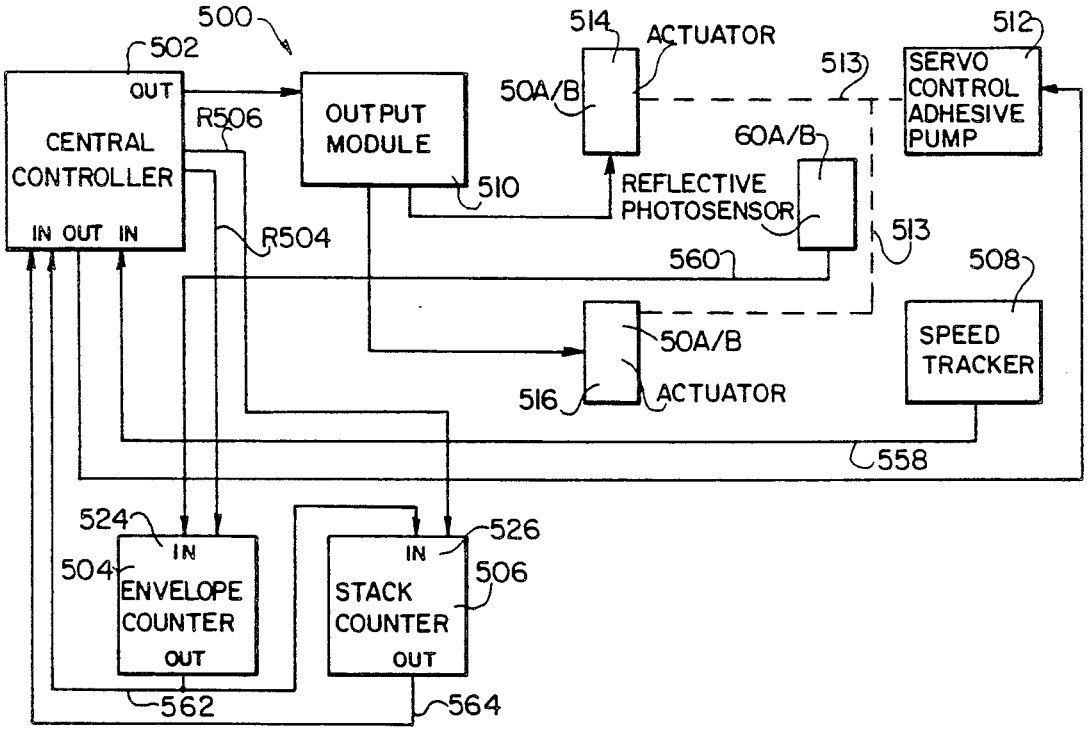

BONDED ENVELOPE STACK AND METHOD AND APPARATUS FOR MAKING SAME

BACKGROUND OF THE INVENTION

1. Field of the Invention

The present invention generally relates to packaging and finishing paper envelopes during the envelope manufacturing process and is more specifically directed to a package of vertically aligned plural envelopes secured in a unitized stack using plural adhesive spots to secure each envelope in the stack to a superior or subjacent envelope. The present invention is also directed to a method for producing such a unitized stack and to apparatus for carrying out the method.

2. Prior Art

It has been conventional practice to provide banded stacks of paper envelopes vertically aligned one on top of the other with the envelopes being held in position by a band of paper, cellophane or the like encircling the envelope stack midway between the ends of the envelopes in a beltlike manner. A shortcoming of such banded envelope stacks is that after a few envelopes are removed, the remaining envelopes are loosely held in the stack and easily become disassociated from the stack. Another disadvantage of such banded envelope stacks is that the banding apparatus for forming such stacks is expensive and the cost of installing such apparatus on a conventional envelope machine is approximately $65,000 while the cost of installing the subject invention is only approximately $12,000. A further advantage of the present invention is that it is usable with envelopes of practically any size, whereas conventional banding apparatus is only usable for banding envelopes in a restricted size range. A further advantage of the present inventive apparatus is that it can be easily removed from one envelope machine and installed on another envelope machine.

Prior art investigators have attempted to produce a unitized arrangement of bags by adhering adjacent bags using adhesive. For example, Wing U.S. Pat. Nos. 3,587,844 and 3,587,845, both disclose an elongated strip array of heat shrinkable plastic bags held together in an imbricated manner by adhesive or two-sided tape. The '844 patent discloses an elongated chain of overlapping imbricated bags which are held together with splotches of adhesive such as 20 and 21 shown on bag 22. The '845 patent is the same as the '844 patent except that the adhesive splotches are replaced with two small swatches of two-faced adhesive members 20 and 21 or by heat and pressure as illustrated in FIG. 5 of the patent.

Farrelly et al., U.S. Pat. No. 3,915,302, discloses an elongated strip of overlapping plastic bags attached to a pair of adhesive tapes 50 and 52. Adhesive means 34 releasable adheres the lower side of bag 10 to the upper side of bag 30, while adhesive means 44 in like manner releasable adheres the lower side of bag 30 to the upper side of bag 44.

Perecman, U.S. Pat. No. 4,502,599, discloses a pack of resealable plastic bags which is formed by stacking the bags directly on top of one another in vertical alignment (i.e., not overlapped or imbricated), with the package being held together by adhering one bag to the next with a strip of pressure sensitive adhesive on the sealing flap of each successive bag connected to the back of the sealing flap of the bag on top of it.

Wilson, U.S. Pat. No. 4,674,634, also discloses a stack of plastic bags which are held together by a reclosable adhesive seal on each bag flap. However, the bags are stacked with the flaps at alternate opposite edges of the stack as shown in FIG. 4 of the patent.

Membrino, U.S. Pat. No. 4,500,000, discloses a pad of open mouthed plastic bags overlying each other and separably connected by a common base portion.

Other investigators have developed apparatus for securing plural bags using adhesive. For example, Farrelly, et al., U.S. Pat. No. 4,534,752, discloses an apparatus for securing the top ends of sack gussets. In FIG. 7, two adhesive guns, 48 and 49, are mounted over two slots 75 in a bracket 65 to apply glue to sacks passing beneath the bracket.

Stemmler, U.S. Pat. No. 3,400,642, discloses an envelope folding and gumming apparatus with a cylinder 22 having applicator segments 23 attached on opposite sides. Adhesive from reservoir 26 is applied to the applicators 23 by a roller 25. The applicators 23 then come in contact with the side flaps of envelopes upon rotation of cylinder 22.

Cone, U.S. Pat. No. 4,373,986, discloses a gluing machine with glue applicator assembly 22 (located in upper right side of FIGS. 1 and 3) which deposits glue at spaced-apart intervals on a continuous carrier sheet C. Projections 284 on a raised transfer roller 280 determine the pattern and spacing of the glue applied to carrier sheet C by pushing the sheet into contact with adhesive coated roller 290. The carrier sheet C is then contacted with the material to be glued.

Dohnalic, U.S. Pat. No. 3,450,009, discloses an envelope making machine with rotary applicators 82A and 82B (see FIGS. 4 and S) mounted on a shaft 94. The rotary applicators 82A and 82B apply adhesive in a V-shaped pattern to the edged portions of envelopes as they are directed past them by roller 80.

Helm, U.S. Pat. No. 3,630,125 shows the continuous application of a band of adhesive to overlapped edges of envelopes. The size of the glue patch is controlled by the amount of overlap of the envelopes.

Helm U.S. Pat. No. 3,747,561, discloses an adhesive application mechanism for envelope processing machinery, in which an adhesive applicator roll 10 is located inside an adhesive box 22. The adhesive box 22 ma be operated remotely, or manually when necessary, in order to raise the adhesive box 22 to prevent the transfer of adhesive to the applicator dies (not shown) which apply the adhesive to the flaps of envelopes.

Helm U.S. Pat. No. 4,138,933, discloses an apparatus for gumming and folding open-end envelopes which uses a cylinder 66 (see FIG. 2) to apply adhesive to envelope flaps. The adhesive is provided by roller 74 from adhesive reservoir 72. The envelope folding apparatus of the '933 patent is similar in construction to the Smithe RA-800-type folding machine used in the present invention. Smithe et al., U.S. Pat. No. 3,641,883, discloses a method and apparatus for folding a closure flap of an envelope. Helm, U.S. Pat. No. 3,745,894 also utilizes a flap folding apparatus. Bethke, U.S. Pat. No. 3,847,384, discloses a collating machine with many elements in common with the other Smithe envelope folding and gluing machines.

Thus, the prior art fails to show a unitized bonded stack of paper envelopes held together by the careful placement of two adhesive splotches on the front of each envelope which enable each envelope to adhere to the back of the envelope placed directly on top of it.

The prior disclosures relating to envelope folding and gumming machines generally relate to placing a strip of glue near or at the edge of the flaps on envelopes. The gumming machines, such as those disclosed by Stemmler, Hornung and Helm, generally use a roller to apply the adhesive. Cone utilized a continuous carrier sheet from which glue was then applied to envelopes or sheets of material.

Farrell et al., U.S. Pat. No. 4,534,752 discloses the use of two adhesive guns mounted over slots in a bracket to apply glue to gussets of large sacks such as those used for selling pet food and the like.

The present invention uses two Vansco high-speed actuators with applicator heads in alignment with two slots cut through the steel flap trap plate of a Smithe RA-800-type fold machine in a similar fashion to the '752 patent. Certain disadvantages of the prior art are overcome through the use of a dual-counter mechanism installed on a conventional envelope machine to count the number of envelopes which have been processed in a batch, the use of a releasable type of adhesive, placement of the adhesive in a specific location on envelopes, and providing novel timing and processing by which the items to be glued are brought before the adhesive applicators, each of which "spits" a dot of glue onto each envelope following which the envelopes are forwarded to further processing steps. The delivery cylinder of the folding machine is provided with two grooves which match the slots in the steel flap trap plate to thereby prevent adhesive on the envelopes from being wiped onto the cylinder when the cylinder removes the envelope from the flap trap plate for transfer to the delivery spiral. The present invention associates envelopes directly against one another soon after the adhesive is applied so as to provide a stack when the adhesive dots dry.

Therefore, the prior art appears deficient in showing a unitary device and/or method which performs all of the functions of the present invention.

SUMMARY OF THE INVENTION

One object of the present invention is to provide a unitized, bonded stack of paper envelopes in which individual envelopes are easily detached from the bonded stack either manually or by machine.

Another object of the present invention is to provide a unitized, bonded stack of envelopes in which the envelopes are secured without a paper wrapper or other external means of adherence.

Another object of the present invention is to provide a bonded stack of envelopes which can be received and processed by an unmodified conventional envelope insertion machine.

Yet another object of the present invention is to provide a method of manufacturing a bonded stack of envelopes which method is efficient, simple, and requires little retraining of folding machine operators.

A further object of the present invention is to provide relatively inexpensive apparatus usable on a conventional envelope machine for manufacturing a bonded stack of envelopes.

These objects, and other objects which will become apparent from the specification below, are achieved through provision of an envelope unitizing concept in which envelopes in a stack are inter-connected by application of two spots of adhesive on the front panel of each envelope to engage the lower panel of the next above envelope. By stacking the envelopes in this fashion, traditional methods for unitizing envelopes, such as paper, film bands and shrink film wraps or boxes are unnecessary. The invention relates to the unitized envelope product, the process for producing the unitized envelope product, and the adaptations made to the envelope folding and gumming machines in order to unitize the envelopes.

In one embodiment of the present invention, an F. L. Smithe RA-800-type folding machine is modified to enable the careful application of the two spots of adhesive on the front panel of each envelope by two automatic adhesive applicators.

The invention also includes means for producing bonded envelope stacks having a given fixed quantity of envelopes. An envelope on the transfer cylinder feeding the envelope to the folding machine seal folder flap trap of a conventional envelope machine passes a photocell which detects and triggers one counter of a dual counter system. After a given time delay sufficient to permit the envelope to be positioned in the folder trap, the two glue applicator heads are activated to propel two glue dots onto the envelope. A first counter increments each time an envelope is detected, until a count termed "preset 1" is reached. This "preset 1" count thus represents the number of envelopes desired in each bonded stack of envelopes (typically 12 or 24).

When "preset 1" reached by the first counter, the glue applicator is deactivated for one cycle to permit the next envelope to pass through the folder tray without the application of glue to it. A second counter is then incremented. When a second present quantity (termed "preset 2") is reached by the second counter, the second counter is reset and the apparatus is deactivated. Thus the second counter operates to count the total number of bonded stacks produced by the apparatus and then cuts off the apparatus when the desired number of stacks has been produced.

In ordinary use in an unmodified folding machine, an envelope enters the seal folder flap trap, stops, and reverses direction. According to the present invention, when an envelope stops and reverses direction, preferably two spots of adhesive from two high speed glue actuators with applicator heads apply adhesive on front of the envelope near the bottom fold.

In one embodiment, the inventive apparatus is made by modifying a Smithe RA-800-type folding machine by cutting two slots through the seal flap trap plate (part no. RA-80634) and attaching high speed actuators with applicator heads over the slots so that the applicator heads are proximate to the envelope in the trap. The delivery cylinder (RA-80186) is also modified by cutting two grooves in positions corresponding to the location of the slots in the seal flap trap plate. These grooves allow the envelope to be transferred by the delivery cylinder to the delivery spiral without wiping adhesive on the delivery cylinder. The photo cell, counter and control system to implement this gluing step are of conventional construction.

Alternatively, in a second embodiment the glue applicators are positioned over the delivery spirals, eliminating the need for cutting slots in the folder flap trap or for providing additional grooves in the delivery cylinder. In both embodiments, an adjustable stop disk is mounted coaxially with the delivery spirals to enable precise adjustment of the delivery position of a finished, folded envelope. These stops thereby permit the adhesive to be placed in a precisely defined position on the envelope face prior to application of the glue dots.

BRIEF DESCRIPTION OF DRAWINGS

FIG. 2 is an end elevation taken along line 2—2 of FIG. 1.

FIG. 3 is a perspective view of a bonded stack of envelopes of the present invention.

FIG. 4 is a side elevation of the modified seal flap trap plate of the present invention.

FIG. 5 is a block diagram of the control equipment used to operate the inventive apparatus.

DETAILED DESCRIPTION OF THE PREFERRED EMBODIMENTS

Figure 1:
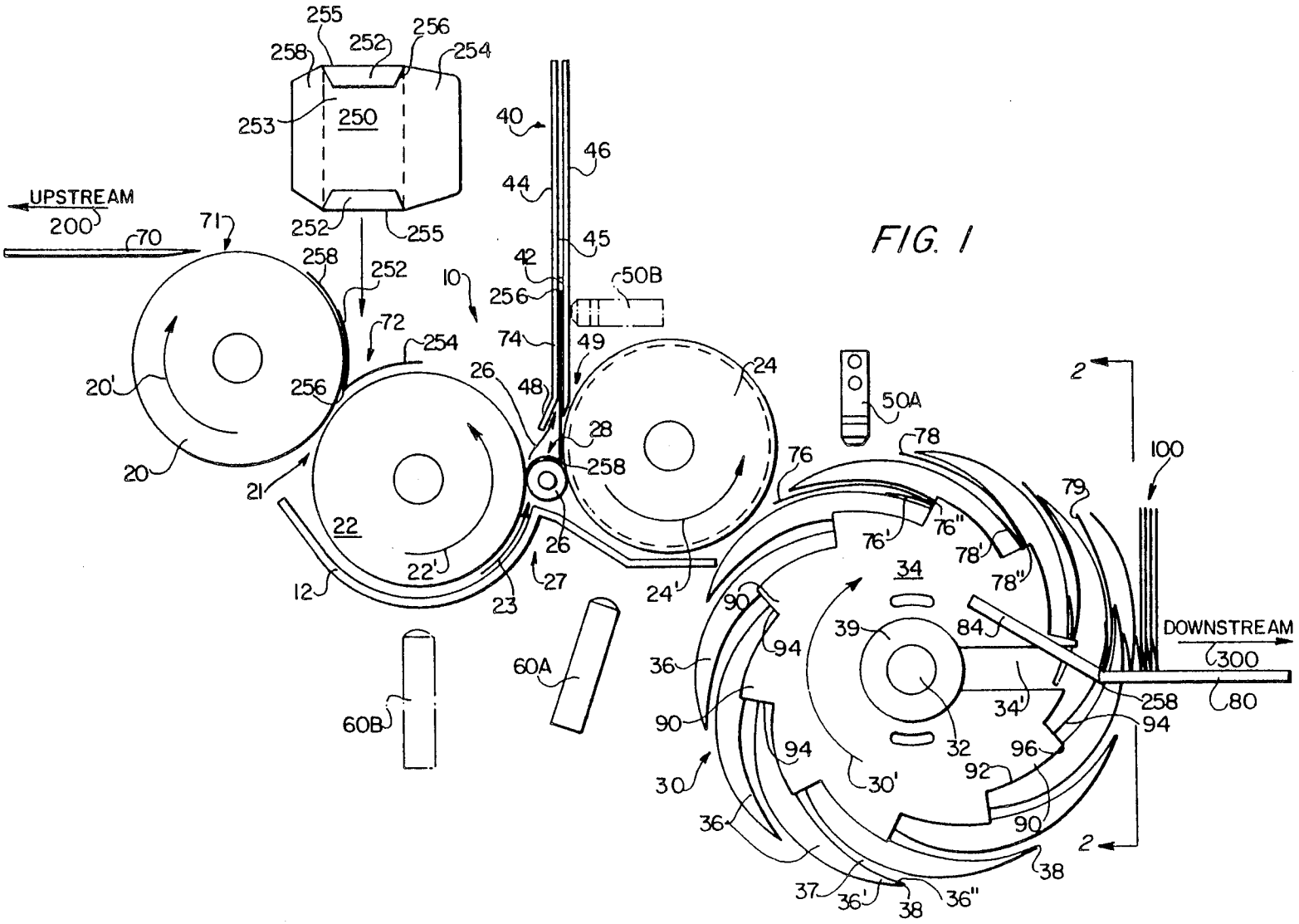
FIG. 1 is a schematic side elevation of the internal mechanical equipment of an envelope machine incorporating the apparatus of the present invention.

The following detailed description of the preferred embodiments incorporates certain specific technical terminology. However, the invention is not limited to structures having the specific technical terms employed; rather, the invention encompasses all technical equivalents for the terminology used.

A. Structure of Bonded Stack and Manufacturing Apparatus

This section discusses the structure of the bonded stack of envelopes and the apparatus used to manufacture the stack. Operation of the apparatus, and the method for operating the apparatus, are discussed in the following section labeled "B".

Referring generally to FIGS. 1 through 5, and referring specifically to FIGS. 1 and 2, apparatus 10 is shown for manufacturing a bonded stack of envelopes. The apparatus 10 generally comprises a bottom flap folding cylinder 20, transfer cylinder 22, delivery cylinder 24, seal fold cylinder 26, delivery spiral 30, delivery table 80, and seal fold flap trap 40. These parts 20, 22, 24, 26, 30, 80, and 40 are secured to a suitable machine frame (not shown) of conventional construction and may be incorporated in a larger machine which includes envelope blank feeding means, finished envelope printing means, and other machinery.

The apparatus 10 is constructed having an upstream end 200 and a downstream end 300. In operation, envelope blanks are fed from conventional machinery mounted at upstream end 200 and travel through the apparatus 10 to reach downstream end 300.

Cylinders 20, 22, 26, and 24 each comprise a metal-sheathed cylinder of conventional construction mounted on an axle (not shown) and connected to a coordinated motorized geared drive train mechanism (not shown) in known manner. Examples of conventional prior art machinery incorporating similar cylinders in a similar arrangement are shown in the Helm patents referenced above and in a brochure for the RA-800-type folding machine published by F. L. Smithe Company. Each of cylinders 20, 22, 24, and 26 incorporate vacuum gripping means of known construction, comprising a plurality of small holes (not shown) arranged in the cylinder surface linearly parallel to the axis of rotation of cylinders 20, 22, 24, and 26. A single line of vacuum holes is preferred. An industrial vacuum supply is connected in known manner to cylinder 20, 22, 24, and 26, thereby inducing vacuum suction through the holes. Thus, when an envelope blank is fed onto any one of cylinders 20 through 26, vacuum suction through the plural holes will grip the envelope paper and hold it tightly against the surface of the cylinder. The vacuum supply is connected to the line of holes for each cylinder 20 through 26 so that the vacuum to the line is terminated at desired angular positions of rotation of the cylinder to release envelopes for feeding to the next downstream cylinder; similarly, vacuum acts through each line of holes at angular positions of rotation necessary to engage and retain envelopes being fed onto the cylinders.

Bottom flap fold cylinder 20, transfer cylinder 22, and delivery cylinder 24 preferably have substantially equivalent diameters. In contrast, seal fold cylinder 26 is constructed having an exterior diameter substantially less than the diameter of cylinders 20, 22, and 24. This smaller diameter is used because in operation, as discussed in detail below, seal fold cylinder 26 moves an envelope blank over a considerably shorter lateral downstream distance than do cylinders 20, 22, and 24.

Bottom flap folding cylinder 20 is driven to rotate in a clockwise direction as indicated by arrow 20'. Transfer cylinder 22 is similarly driven to operate in a counterclockwise direction, and cylinder 22 is mounted in close proximity to cylinder 22 such that an envelope blank pinch gap 21 is defined by the proximate exterior surfaces of cylinders 20 and 22. The rotational axes of cylinders 20 and 22 are preferably offset in the vertical direction such that cylinder 22 is mounted lower in the machine frame than cylinder 20.

Seal fold cylinder 26 is mounted on the machine frame between cylinders 22 and 24; the axis of rotation of cylinder 26 is parallel to and substantially coplanar with the axis of rotation of cylinder 22. Cylinder 26 is mounted in close proximity to both cylinders 22 and 24, such that the proximate exterior surfaces of cylinder 26 and cylinder 22 define a second pinch gap 27. Similarly, the proximate exterior surfaces of cylinder 26 and cylinder 24 define a third envelope pinch gap 28. As discussed below, pinch gaps 21, 27, and 28 operate to fold an envelope blank when the blank is forced into the pinch gaps 21, 27, or 28 by the cylinders forming the gap.

Delivery cylinder 24 preferably comprises a modified part no. RA-80186 of a Smithe RA-type folding machine. As shown in FIG. 2, cylinder 24 conventionally includes five spaced-apart clearance grooves 25.

As indicated in FIG. 2, cylinder 24 is modified according to the present invention by the addition of preferably two additional glue clearance grooves 24A. In an alternative embodiment, only one glue clearance groove 24A is used. Grooves 24A are positioned circumferentially along cylinder 24 in alignment with the position of the nozzles of glue applicators 50B. Thus, when nozzles 52 emit glue spots onto the surface of envelope E shown in FIG. 2, the wet glue does not contact the surface of cylinder 24 but instead is aligned over grooves 24A to preclude contact of the glue with cylinder 24.

Mounted vertically proximate to cylinder 24 is seal fold flap trap 40, shown in a side view in FIG. 1. In a preferred embodiment, the trap 40 is of conventional construction and includes a generally rectangular, planar upstream wall 44 and a similarly rectangular, planar downstream wall 46.

In an alternative embodiment, used with glue applicators 50B and photocell 60B, downstream wall 46 is modified to have the configuration shown in FIG. 4. Preferably two elongated slots 402 and 404 are cut in wall 46 to provide clearance for glue applicators 50B, enabling glue to be applied through slots 402 and 404 to envelopes 74 momentarily stopped inside trap 40. The slots 402 and 404 are preferably ½" in width and are cut in part no. RA-80634 of the Smithe RA-type folding machine. In FIG. 4, wall 46 is shown with adjustable stop 42 in its lowermost position. Slots 402 and 404 are each defined by parallel elongated opposite side edges 410 and 412 and by a preferably semicircular end 406. Each slot 402 or 404 is provided with a downward-facing open end 408.

Referring again to FIGS. 1 and 2, walls 44 and 46 are separated by a narrow air gap 45 into which an envelope may be drawn to accomplish certain folding functions during operation of the apparatus 10. Air gap 45 is preferably only slightly wider than the thickness of a typical envelope. Flap trap 40 is further provided with a vertically adjustable envelope stop 42 which enables trap 40 to accommodate envelopes of different dimensions. The stop 42 may be moved vertically to any one of a plurality of positions corresponding to the vertical height of a given envelope.

Mounted downstream of cylinder 24 are preferably three rotatable delivery spirals 30, one of which is shown in the side view of FIG. 1. As is known in the art, delivery spirals 30 rotate about axis 32 in a clockwise direction as indicated by arrow 30'. The spirals 30 each comprise a plurality of arcuate receiving arms 36 secured to a central core (not shown). The arms 36 each include an arcuate outboard edge 36', an inboard arcuate edge 36", and a tip 38 constructed such that, in shape, the arms 36 resemble a half-crescent. The spirals 30 each preferably include ten (10) receiving arms 36.

Each receiving arm 36 is separated from an adjacent arm 36 by a relatively narrow arcuate air gap slot 37; each air gap slot 37 is constructed wide enough to receive a desired envelope and its flap.

Mounted coaxially with spirals 30, and rotatable on shaft 32, are plural adjustable stops 34 shown in FIG. 1 and 2. Preferably two adjustable stops 34 are used in conjunction with two of the three delivery spirals 30. The stops 34 are preferably constructed of 0.125"-thick aluminum plate. In structure the stops 34 resemble a circular saw blade, having plural stop teeth 90 each comprising an arcuate outer edge 92 and a leading edge 94 connected to edge 92 at a nearly right angle point 96. Each edge 94 defines the bottom of each air gap slot 37 which can be moved in or out by adjusting the rotary position of stop 34 relative to its associated delivery spiral. Preferably the number of stop teeth 90 corresponds to the number of delivery spiral arms 36 provided on spirals 30.

As is shown in FIG. 2, plural chucks 39 are provided to retain the stops 34 in place in close proximity to spirals 30. The chucks 39 are constructed using conventional means such as a collar retained by a set screw or other suitable fastener. Further, to enable the stops 34 to be quickly removed from the apparatus 10 without disassembling the spirals 30, each stop is provided with an elongated access slot 34' shown in FIG. 1. The slot 34' enables the stop 34 to be removed from axle 32 when chucks 39 are loosened. Plural slots 82 are provided in table 80 to clear both spirals 30 and stops 34, thereby dividing table 80 into a plurality of elongated receiving fingers 84.

As is further shown in FIGS. 1 and 2, the apparatus 10 includes electromechanical adhesive applicators 50A preferably mounted on a mounting rail 54 vertically proximate to delivery spirals 30 and proximate to delivery cylinder 24. In the end view of FIG. 1 only one adhesive applicator 50A is shown, but preferably two (2) applicators are used and are mounted using conventional fasteners on a mounting rail 54 as shown in FIG. 2. Rail 54 is secured to the machine frame using conventional fasteners 56. Applicators 50A eject a fixed quantity of adhesive through nozzles 52 upon a formed and folded envelope 76 immediately after the envelope is received by delivery spirals 30. The adhesive applicators 50A or 50B preferably comprise VANSCO 40-40-00 high speed actuators with A-1892 special applicator heads, available from VANSCO Precision Adhesive Placement, 2652 Lashbrook Avenue, South El Monte, Calif. 91733. Alternative applicators include the Valco Cincinnati Model 585 Hi-Speed Valve, available from Valco Cincinnati, 411 Circle Freeway Drive, Cincinnati, Ohio 45246.

An alternate mounting position for the adhesive applicators is designated 50B in FIG. 1 and is located adjacent to flap trap 40 such that adhesive application occurs when an envelope blank 74 is momentarily stopped in the flap trap 40. Placement of the adhesive applicator 50A in the position located over the spirals is preferred and allows placement of adhesive over a larger area of the envelope. This location is also possible on all folding machinery. Placing the applicators in position 50B is not possible on all folding machinery due to the construction of some types of flap traps.

The adhesive used in the apparatus 10 preferably is a dextrine type of adhesive comprising approximately 50% glue and 50% added wax. The adhesive composition preferred is Adcon B-8182 sold under the trade name VANSCO Fugitive Gum. Other suitable glue for the applicators may be obtained from Adhesives Consultants Group, 2532 Commerce Place, Tucker, Ga. 30084.

Application of glue, and overall operation of apparatus 10, is supervised by electronic control means 500 shown in the diagram of FIG. 5. The control means 500, the components of which are well known in the art, comprises a central controller 502 which receives input from envelope counter 504, stack counter 506, and speed tracker 508. Speed tracker 508 monitors the motor speed and throughput speed of the entire apparatus 10 and provides feedback data to controller 502 using communication line 558.

Controller 502 is operatively coupled to, and also sends electronic commands to output module 510, which module 510 contains amplification and control circuitry known in the art to trigger glue applicator actuators 514 and 516. Actuators 514 and 516 are operatively coupled to glue applicators 50A and 50B. Upon receiving a trigger pulse from output module 510, actuators 514 and 516 cause applicators 50A and 50B to apply glue supplied by servo control adhesive pump 512. The pump 512 draws glue from a glue supply reservoir (not shown) and supplies the adhesive to applicators 50A and 50B using adhesive supply lines 513 in known manner.

Reflective photosensors 60A and 60B comprise conventional "electric eye" photocells. When a highly light-reflective object, such as an envelope, passes the photosensors 60A and 60B, the photosensors 60A and 60B generate an electronic output pulse on output line 560. Line 560 is coupled to input points 524 and 526 of counters 504 and 506 as shown in FIG. 5.

Counters 504 and 506 are each conventional electronic photocell-triggered single-shot counters. Counter 504 is operatively coupled to controller 502 using reset line R504 and counter output line 562; output line 562 is also connected to input 526 of counter 506. In operation, counter 504 is triggered by a trigger pulse received from photosensor 60A or 60B on line 560 at input point 524. In response, counter 504 increments its internal count. When the internal count equals a preset internally stored fixed count, also termed "preset 1," counter 504 generates an output pulse on line 562. This pulse is supplied both to controller 502 and to the input 526 of counter 506. As discussed below, an counter 504 generates an output pulse each time a completed bonded envelope stack is produced by the apparatus 10.

Counter 506 has a single input 526 coupled to the output line 562 of counter 504. Counter 506 increments its internal count upon receiving an input pulse on line 562. When the internal count of counter 506 equals a preset internally stored fixed count, termed "preset 2," counter 506 generates an output pulse on output line 564, which is operatively coupled to controller 502. As discussed below in the operation section, a pulse is generated on output line 564 each time a job run of plural complete bonded envelope stacks is finished.

Both counters 504 and 506 may be reset to a zero count by communication of a reset pulse from controller 502 on lines R504 or R506.

The various components of control means 500 preferably comprise modules available from VANSCO Precision Adhesive Placement at the address specified above. Central controller 502 may comprise VANSCO Micro-Track Control 45-50-01; speed tracker 508 may comprise VANSCO Speed Tracker 95-03-02 with 95-02-xx 3 wire cable assembly; output module 510 may comprise VANSCO Output Module 95-02-04 with 95-02/06-XX Driver Board; photosensors 60A and 60B may comprise VANSCO Reflective Photosensor 95-01-86; servo control 512 may comprise VANSCO Adhesive Pump 20-02-05 with 78-00-XX inlet and outlet kits.

One embodiment of apparatus 10 according to the present invention may be accomplished by making certain modifications to an F. L. Smithe RA type folding machine. These modifications include:

1. Modification of the seal flap trap plate (part RA-80634) by cutting two elongated parallel slots through the plate. These slots each provide clearance for a conventional glue applicator to place adhesive on the front of an envelope near the bottom fold. The slots also permit the complete envelope to exit the trap without wiping adhesive on the plate.

2. Modification of the delivery cylinder (part RA-80186) by cutting two grooves that match the slots in the seal flat plate. These groove allow envelopes to transfer around the cylinder without wiping adhesive on the cylinder.

3. Modification of the delivery spirals by adding movable stops. When the optional glue applicator location over the spirals is used, the stops are needed for better control of adhesive placement.

4. Addition of two additional counter and computation systems to detect the number of envelopes and envelope packs produced. When an envelope enters the seal folder trap, a photocell detects and operates a dual counter system. Each time an envelope passes through the photocell beam, a count is registered, until the "preset 1" count is reached. At that point, the glue applicator valve is deactivated until "preset 2" is reached. At "preset 2" the counter resets and another count is ready.

An exemplary bonded envelope stack produced by the apparatus 10 is shown in FIG. 3 and designated 100. The stack 106 comprises plural conventional envelopes 106 Each envelope 106 includes a rear panel 102 and a front panel 104 to which the apparatus 10 applies a small spot or dot of adhesive 120. Preferably the adhesive dot 120 is applied adjacent each corner 108 of the envelope 106. In this position the adhesive 120 adheres to a target area 122 of an adjacent envelope 110.

In similar fashion adhesive 120 is applied to each of the other envelopes 106 in the stack. The resulting product is a convenient bonded stack of envelopes from which individual envelopes may easily be removed without loosening the entire stack of remaining envelopes. In the prior art bundles of envelopes are typically secured using paper bands, cellophane bands, or other encircling means. When the band is broken, or when one envelope is removed from the stack, the entire stack is loosened and envelopes in the stack become dislodged. However, the inventive stack 100 avoids this disadvantage since the entire stack retains its bonded integrity no matter how many envelopes are removed.

B. Operation of Apparatus; Manufacturing Method

As stated above, the apparatus 10 includes an upstream end 200 and a downstream end 300. In operation, a partly formed envelope blank 70 enters the apparatus 10 at the upstream end. At this point, the blank 70 is partly formed as shown by the envelope 250 represented in plan view in FIG. 1. Side flaps 252 have been folded along fold lines 255 connecting them to the front panel 253 of envelope 250 when blank 70 reaches the upstream end of apparatus 10. Bottom flap 254 is unfolded but a fold line 256 has been scored on the envelope 250. Adhesive has been applied to the exterior of flaps 252, and sealing flap 258 is unfolded.

The blank 70 moves downstream through the apparatus and at point 71 contacts the exterior surface of cylinder 20. Vacuum suction holds blank 70 against cylinder 20 as cylinder 20 rotates clockwise. The blank 70 then reaches the position of the envelope blank designated by reference numeral 72. Vacuum suction of cylinder 20, and the combined opposite rotation of cylinders 20 and 22, forces blank 72 into pinch gap Or nip 21 between cylinders 20 and 22, inducing a fold on fold line 256; vacuum in cylinder 20 acting on the envelope is terminated to release the envelope which is secured to the surface of cylinder 22 by the vacuum application in cylinder 22. As the blank 72 is pushed through the nip 21, fold 256 forces bottom panel 254 against flaps 252 and the adhesive thereon, adhering panel 254 to flaps 252.

The blank 72 is held against cylinder 22 through vacuum suction and travels around cylinder 22 into pinch gap or nip 27 along the path indicated by arrow 23. At this point sealing flap 258 is still unfolded. Vacuum suction of cylinder 22 is released, permitting the blank 72 to contact cylinder 26; the blank 72 then travels upward along the path indicated by arrow 26'. Vacuum suction of cylinder 26 attracts flap 258 to the surface of cylinder 26, guiding the blank into the position designated 74 in FIG. 1. The blank 74 thus enters the air gap 45 of the sealing flap trap 40 and travels upward between walls 44 and 46 until fold 256 of blank 74 strikes the envelope stop 42.

If the glue applicators have been mounted in position 50B indicated in FIG. 1, a cycle is initiated by detection of the envelope by the photo cell 60A and glue is applied to the envelope 74 after a predetermined time delay after detection of the envelope by photosensor 60A during the time the envelope 74 is positioned against stop 42. A spot of adhesive from each of two applicator valves 50B is placed on the envelope 74. The pattern of adhesive is preferably on the face of envelope 74, about ½ inch from the bottom fold 256 and 2¾ inches from the center of each side.

The blank 74 then reverses direction and moves downwardly out of trap 40. Vacuum suction from cylinder 24 attracts the front panel 253 of envelope 74 against cylinder 24. Counterclockwise rotation of cylinder 2 then draws envelope blank 74 into pinch gap 28 between cylinder 24 and 26. As FIG. 2 shows, the two grooves 24A cut in cylinder 24 prevent wet adhesive on envelope 74 from contacting the surface of the cylinder 24 as the envelope 74 moves in the path indicated by arrow 24'. Vacuum pressure in cylinder 24 is then momentarily released, allowing the top edge of envelope 74 to rotate into and be received by delivery spiral 30 in known manner.

In the preferred embodiment, photosensor 60A detects the envelope on cylinder 24 to initiate a cycle so that glue is applied by applicators 50A after a required time delay as envelope blank 74 moves past the position of blank 76 in FIG. 1.

In FIG. 1, reference numerals 76 and 78 designate envelopes which have been received by delivery spiral 30 and captured between two adjacent arms 36. Envelope 76 includes formed envelope flap 76' formed at fold point 76'', and envelope 78 includes a flap 78' formed at fold point 78''. The envelopes 76 and 78 are retained between a pair of arms 36 by slight outward spring tension caused by folds 76'' and 78'' of flaps 76' and 78'. This tension causes flaps 76' and 78' to push outward against arms 36, thereby retaining envelopes 76 and 78 in position through friction as spiral 30 rotates.

Through further rotation of spirals 30, envelopes received by the spirals 30 reach the position of envelope 79 whereupon the top flap 258 of envelope 79 strikes the fingers 84 of delivery table 80. Continued rotation of spirals 30 forces flap 258 of envelope 79 to slide laterally downstream along table 80 until envelope 79 strikes an adjacent envelope and joins and is bonded to envelope stack 100. This lateral downstream motion of envelope 79, caused by rotation of spirals 30, presses the wet glue on envelope 79 against an adjacent envelope in stack 100, adhering the envelopes and forcing envelope 79 to become part of completed bonded stack 100.

Application of glue, and overall operation of apparatus 10, is controlled by means shown in the diagram of FIG. 5.

Each time an envelope is processed, one of photocells 60A or 60B (depending upon whether the preferred or alternative embodiment is used) detects the presence of an envelope and generates a trigger pulse. As discussed above, a dual counter system comprising counters 204 and 206 is employed to count envelopes and bonded stacks. The first counter 204 increments each time a trigger pulse is received from photocell 60A or 60B, until a count termed "preset 1" is reached. This "preset 1" count thus represents the number of envelopes desired in each bonded stack of envelopes (typically 12 or 24). When "preset 1" reached by the counter 204, the glue applicator in either position 50A or 50B is deactivated, and counter 204 is reset to zero. Deactivation of glue applicators 50A or 50B causes the next envelope to pass through the apparatus 10 to the bonded stack 100 without having glue applied. However, the prior envelope in stack 100 will have glue on it, and consequently the next envelope will adhere to it, becoming the last envelope in the bonded stack. Since no glue is placed on this envelope by the deactivated applicators 50A and 50B, no further envelopes will adhere to this envelope and the machine operator can remove the complete bonded stack having a desired number of envelopes.

A second counter 206, termed the stack counter, is then incremented; stack counter 206 thus records the number of complete bonded stacks produced by the apparatus. When a second present quantity (termed "preset 2") is reached by counter 206, counter 206 is reset to zero and the apparatus 10 is deactivated. At this point the apparatus 10 has produced the number of complete stacks desired for a particular manufacturing run and the job is therefore complete.

The foregoing invention may be practiced in means other than those specifically described in connection with this specification and drawings. Thus, within the scope of the appended claims, the invention includes all technical equivalents performing substantially similar functions in substantially similar manner to produce substantially similar results.

What is claimed is:

1. Apparatus for manufacturing a bonded vertically aligned stack of envelopes from partially formed envelope blanks comprising a front panel having opposed top and bottom edges and opposed side edges, a bottom flap extending from the bottom edge of the front panel, a sealing flap extending from the top edge of the front panel, and side flaps extending from the side edges of the front panel and folded against the front panel, said apparatus comprising:

(a) a machine frame;

(b) a clockwise rotatable bottom flap folding cylinder mounted on said machine frame;

(c) a counterclockwise rotatable transfer cylinder mounted on said machine frame downstream of and parallel to said folding cylinder, said bottom flap folding cylinder and said transfer cylinder cooperating to fold the bottom flap of a partially formed envelope blank against the side flaps to form a partially formed envelope, the side flaps, the bottom panel, and the front panel defining a pocket;

(d) a clockwise rotatable seal fold cylinder mounted on said machine frame downstream of and parallel to said transfer cylinder for selectively holding the top flap of the partially formed envelope;

(e) a counterclockwise rotatable delivery cylinder mounted on said machine frame downstream of and parallel to said seal fold cylinder, said delivery cylinder and said seal fold cylinder each having exterior surfaces defining an envelope pinch gap and cooperating to fold the top flap of the partially formed envelope against the front panel and side flaps to form a fully formed envelope;

(f) a seal fold flap trap secured to said machine frame vertically above said pinch gap for receiving the pocket of the partially formed envelope, said seal fold flap trap including a downstream vertical wall having plural parallel spaced-apart vertically elongated slots;

(g) glue application means for applying glue to the front panel;

(h) envelope sensing means secured proximate to said delivery cylinder for sensing the presence of a partially formed envelope at said seal fold flap trap;

(i) plural delivery spiral means mounted on said machine frame downstream of said delivery cylinder for receiving envelopes from said delivery cylinder, said spiral means having plural spiral receiving arms, pairs of said arms defining envelope receiving slots having a predefined depth;

(j) delivery table means for receiving plural envelopes in a stack from said spiral means; and (k) control means for dynamically controlling said glue application means, comprising:

a central controller having plural input lines and plural output lines coupled to said glue application means;

an output module operatively coupled to said controller;

photoelectric sensor means for sensing an envelope on said delivery cylinder, said sensor means being mounted adjacent to said delivery cylinder and being operatively coupled to said controller;

first counter means operatively coupled to said controller for counting a first quantity of envelopes in a bonded stack and for electrically communicating said first quantity to said controller; and second counter means operatively coupled to said controller for counting a second quantity of envelopes in a bonded stack and for electrically communicating said second quantity to said controller.

2. The apparatus of claim 1, wherein said envelope sensing means comprises a photocell responsive to ambient light reflected from said envelope, said photocell being operatively coupled to said control means.

3. The apparatus of claim 1, said glue application means comprising:

a glue reservoir adjacent said machine frame; and plural high-speed glue actuators each having glue supply tubes coupled to said glue reservoir and each having electric actuation lines operatively coupled to said output module.

4. The apparatus of claim 1, further comprising:

(l) plural adjustable spiral stop means for dynamically altering said depth of said receiving slots, said stop means being mounted coaxially to said delivery spiral means.

5. The mechanical means of claim 4, wherein said stop means comprises:

a planar disk mounted coaxially of said spiral means; and plural outwardly-protruding generally triangular teeth, each of said teeth being disposed adjacent one of said receiving slots.

6. In an envelope folding machine a method for manufacturing a bonded vertically overlapping stack of envelopes, comprising the steps of (a) preparing an envelope blank by folding said blank into a partly-formed envelope having a front panel, a bottom panel extending from said front panel and separated therefrom by a fold line, and plural side flaps secured in an unfolded state to said front panel, said plural side flaps having wet glue thereon, and a top flap secured to said bottom panel with a second fold line;

(b) folding said bottom panel to adhere to said wet glue of said side flaps;

(c) transporting said blank into an envelope seal fold flap trap;

(d) applying plural spots of glue to said front panel by:

(1) electrically sensing when said partly formed envelope is in said envelope seal fold flap trap;

(2) accumulating first counter means for counting said partly formed envelopes;

(3) testing whether said first counter mean sis equal to a first preset count, and if not, applying plural spots of glue to said front panel, and if so, accumulating a second counter means for counting stacks of envelopes; and (4) testing whether said second counter means is equal to a second preset count, and if so, deactivating said machine;

(e) forming a finished envelope from said blank by folding said top flap on said second fold line; and (f) ejecting said finished envelope adjacent to an aligned stack of envelopes with ejection force sufficient to cause said spots of glue on said front panel to adhere to said adjacent stack of envelopes.

7. Apparatus for manufacturing a bonded stack of envelopes from partially formed envelope blanks comprising a front panel having opposed top and bottom edges and opposed side edges, a bottom flap extending from the bottom edge of the front panel, a sealing flap extending from the top edge of the front panel, and side flaps extending from the side edges of the front panel and folded against the front panel, said apparatus comprising:

(a) a machine frame;

(b) a clockwise rotatable bottom flap folding cylinder mounted on said machine frame having a first axis of rotation;

(c) a counterclockwise rotatable transfer cylinder mounted on said machine frame downstream of said flap folding cylinder and having a second axis of rotation parallel to said first axis, said bottom flap folding cylinder and said transfer cylinder cooperating to fold the bottom flap of a partially formed envelope blank against the side flaps to form a partially formed envelope, the side flaps, the bottom panel, and the front panel defining a pocket;

(d) a clockwise rotatable seal fold cylinder mounted on said machine frame downstream of said transfer cylinder for selectively holding the top flap of the partially formed envelope, said seal fold cylinder having a third axis of rotation parallel to said second axis;

(e) a counterclockwise rotatable delivery cylinder mounted on said machine frame downstream of said seal fold cylinder and having a fourth axis of rotation parallel to said seal fold cylinder, said delivery cylinder and said seal fold cylinder each having narrowly spaced-apart exterior surfaces defining an envelope pinch gap and cooperating to fold the top flap of the partially formed envelope against the front panel and side flaps to form a fully formed envelope;

(f) a seal fold flap trap secured to said machine frame vertically above said pinch gap for receiving the pocket of the partially formed envelope, said seal fold flap trap including a downstream vertical wall having plural parallel spaced-apart vertically elongated slots;

(g) glue application means for applying glue to the front panel, said glue application means being secured to said machine frame adjacent to said slots;

(h) envelope sensing means secured proximate to said delivery cylinder for sensing the presence of a partially formed envelope to said seal fold flap trap;

(i) plural delivery spiral means mounted on said machine frame downstream of said delivery cylinder for receiving envelopes from said delivery cylinder, said spiral means having plural spiral receiving arms, pairs of said arms defining envelope receiving slots having a predefined depth;

(j) delivery table means for receiving plural envelopes in a stack from said spiral means; and (k) control means for selectively and dynamically controlling said glue application means.

8. The apparatus of claim 7, said control means comprising:

an electronic central processing unit having plural input lines and plural output lines;

an output module having output module input lines operatively coupled to said processing unit output lines; and sensor means for sensing the proximity of an envelope on said cylinders, said sensor means being operatively coupled to one of said input lines of said processing unit;

first counter means operatively coupled to said processing unit for counting a first quantity of envelopes in a bonded stack and for communicating said first quantity to said controller;

second counter means operatively coupled to said controller for counting a second quantity of envelopes in a bonded stack and for communicating said second quantity to said controller.

9. The apparatus of claim 8, wherein said sensor means are mounted adjacent to said delivery cylinder.

10. The apparatus of claim 7, said glue application means being secured to said machine frame adjacent to said slots.

11. The apparatus of claim 10, said glue application means further comprising:

a glue reservoir adjacent said machine frame; and plural high-speed glue actuators each having glue supply tubes coupled to said glue reservoir and each having electric actuation lines operatively coupled to said output module.

12. The apparatus of claim 7, said envelope sensing means being secured on said machine frame proximate to said delivery cylinder.

13. The apparatus of claim 7, further comprising:

(l) adjustable spiral stop means for dynamically altering said depth of said receiving slots, said stop means being mounted adjacent said spiral means.

14. The apparatus of claim 13, wherein said stop means comprises:

a planar disk mounted coaxially of said spiral means; and plural outwardly-protruding generally triangular teeth, each of said teeth being disposed adjacent one of said receiving slots.

15. A method of manufacturing a bonded stack of envelopes from partly-formed envelopes, the partly-formed envelopes having a front panel, a bottom panel secured to said front panel with a fold line, and plural side flaps protruding from said front panel and secured to said bottom panel with adhesive means, and a top flap secured to said bottom panel with a second fold line, the method comprising the steps of:

(a) transporting said partly-formed envelope into an envelope seal fold flap trap of an envelope folding machine;

(d) applying to said front panel, plural adhesive means for joining envelopes by:

(1) electrically sensing when said partly formed envelope is in said envelope seal fold flap trap;

(2) accumulating first counter means for counting said partly formed envelopes;

(3) testing whether said first counter means is equal to a first preset count, and if not, applying plural spots of glue to said front panel, and if so, accumulating a second counter means for counting stacks of envelopes; and (4) testing whether said second counter means is equal to a second preset count, and if so, deactivating said machine;

(e) folding said top flap on said second fold line;

(f) ejecting said envelope adjacent to a second envelope using ejection force sufficient to cause said adhesive means on said front panel to adhere to said second envelope.

16. Apparatus for manufacturing a bonded vertically aligned stack of envelopes from partially formed envelope blanks comprising a front panel having opposed top and bottom edges and opposed side edges, a bottom flap extending from the bottom edge of the front panel, a sealing flap extending from the top edge of the front panel, and side flaps extending from the side edges of the front panel and folded against the front panel, said apparatus comprising:

(a) first folding means for folding the bottom flap against the side flaps to form a partially formed envelope, the side flaps, the bottom panel, and the front panel defining a pocket;

(b) trap means for receiving at least the pocket of the partially formed envelope from said first folding means, said trap means including a wall having plural slots therethrough;

(c) glue application means for applying glue to the front panel of the partially formed envelope through said slots in said wall of said trap means;

(d) second folding means for folding the top flap of the partially formed envelope against the front panel and side flaps to form a fully formed envelope;

(e) envelope sensing means for sensing the presence of a partially formed envelope at said trap means;

(f) delivery means for receiving envelopes from said second folding means and ejecting them to form a bonded stack of envelopes; and (g) control means for dynamically controlling said glue application means, comprising:

(i) a central controller having plural input lines and plural output lines coupled to said glue application means;

(ii) an output module operatively coupled to said controller;

(iii) photoelectric sensor means for sensing entry of the pocket of a partially formed envelope into said trap means, said sensor means being operatively coupled to said controller;

(iv) first counter means operatively coupled to said controller for counting a first quantity of envelopes in the bonded stack and for electrically communicating said first quantity to said controller; and (v) second counter means operatively coupled to said controller for counting a second quantity of envelopes in the bonded stack and for electrically communicating said second quantity to said controller.

* * * * *